US005678727A

United States Patent [19]

Rice

[11] Patent Number: 5,678,727

[45] Date of Patent: Oct. 21, 1997

[54] DIAPER DISPENSER APPARATUS

[76] Inventor: William W. Rice, 509 W. Lincoln, Harrisburg, Ill. 62946

[21] Appl. No.: 620,901

[22] Filed: Mar. 25, 1996

[51] Int. Cl.[6] ..... A47F 1/00; A47G 29/00

[52] U.S. Cl. ..... 221/98; 221/102; 221/279; 221/281; 312/71

[58] Field of Search ..... 312/71; 221/59, 221/61, 97, 98, 102, 279, 280, 281, 303, 101

[56] References Cited

U.S. PATENT DOCUMENTS

| | | | |
|---|---|---|---|
| 551,268 | 12/1895 | Edenholm | 221/102 |
| 587,269 | 7/1897 | Nottingham | 221/102 |
| 1,688,242 | 10/1928 | Lawrence et al. . | |
| 1,915,522 | 6/1933 | Eriksen | 221/102 |
| 2,478,815 | 8/1949 | Forman | 221/102 |
| 2,802,575 | 8/1957 | Harrison | 312/71 |
| 2,834,506 | 5/1958 | Schaefer, Jr. . | |
| 3,747,802 | 7/1973 | Uroshevich | 221/63 |
| 3,860,304 | 1/1975 | Bolton . | |
| 4,046,243 | 9/1977 | Valentine . | |
| 4,199,068 | 4/1980 | Weitzner | 312/213 |
| 4,573,608 | 3/1986 | Hansen | 221/92 |
| 4,685,559 | 8/1987 | Titus | 206/561 |
| 4,706,845 | 11/1987 | Schnurer et al. . | |

FOREIGN PATENT DOCUMENTS

| | | |
|---|---|---|
| 0 498 399 A1 | 8/1992 | European Pat. Off. . |
| 410970 | 6/1934 | United Kingdom . |

*Primary Examiner*—H. Grant Skaggs
*Attorney, Agent, or Firm*—Barnes & Thornburg

[57] ABSTRACT

A diaper dispenser apparatus includes a housing having an interior region. The housing includes a front panel formed to include an aperture therein. The apparatus also includes a spring loaded platform located in an interior region of the housing. The platform is configured to support a stack of diapers and to locate a top diaper on the stack in alignment with the aperture in the front panel of the housing to permit removal of the top diaper through the aperture.

19 Claims, 2 Drawing Sheets

DIAPER DISPENSER APPARATUS

BACKGROUND AND SUMMARY OF THE INVENTION

The present invention relates to a dispenser apparatus. More particularly, the present invention relates to an improved diaper dispenser apparatus which stores clean diapers and baby changing accessories and which also provides a storage space for disposal of waste material.

The apparatus of the present invention provides a convenient, space-saving diaper center which dispenses clean diapers and stores soiled diapers. The apparatus keeps changing items neatly organized in one place for convenient access. Diapers are dispensed from the dispenser one at a time as needed. Diapers are removed from the plastic wrappers and loaded into the dispenser so that the plastic wrapper can be thrown away. A storage area or receptacle in a lid or plunger of the unit provides ready access to other changing supplies such as wipes, powder and lotion.

According to one aspect of the present invention, an apparatus is provided for dispensing diapers. The apparatus includes a housing having an interior region. The housing includes a front panel formed to include an aperture therein. The apparatus also includes a spring loaded platform located in an interior region of the housing. The platform is configured to support a stack of diapers and to locate a top diaper on the stack in alignment with the aperture in the front panel of the housing to permit removal of the top diaper through the aperture.

In the illustrated embodiment, the apparatus includes a plunger coupled to a top opening formed in a top end of the housing for applying a downwardly directed biasing force to the stack of diapers and the platform. The plunger is removable to permit loading of diapers onto the platform through the top opening in the housing. The plunger is formed to include a receptacle for receiving articles therein. Illustratively, the plunger receptacle is uncovered to permit easy access to the articles in the receptacle while handling the diapers and a baby.

The aperture formed in the front panel of the housing is spaced apart from the top end of the housing by a predetermined distance. The plunger has a predetermined length from a top surface to a bottom surface of the plunger which is substantially equal to said predetermined distance. The spring loaded platform biases the stack of diapers coupled upwardly against the bottom surface of the plunger to position the top diaper in alignment with the aperture in the front panel of the housing.

In the illustrated embodiment, the spring loaded platform includes at least two springs which have a first end coupled to the platform and a second end coupled to the housing adjacent a top end of the housing. The illustrated platform has a rectangular shape including four corners. Preferably, the spring loaded platform includes a spring located at each corner. Each spring has a first end coupled to the platform and a second end coupled to the housing adjacent a top end of the housing.

According to another aspect of the present invention, an apparatus is provided for dispensing diapers. The apparatus includes a housing having an interior region which is divided into a first portion and a second portion. The housing includes a front panel formed to include an aperture therein. The apparatus also includes a spring loaded platform located in the first portion of the interior region of the housing. The platform is configured to support a stack of diapers. The apparatus further includes a plunger coupled to a top opening formed in a top end of the housing for applying a downwardly directed biasing force to the stack of diapers and the platform to locate a top diaper on the stack in alignment with the aperture in the front panel of the housing to permit removal of the top diaper through the aperture. The plunger is removable to permit loading of diapers onto the platform through the top opening in the housing. The apparatus still further includes a closure device positioned adjacent the top opening of the second portion of the interior region of the housing. The closure device is movable from a closed position to an open position to permit waste material to be inserted past the closure device and into the second region of the housing.

In the illustrated embodiment, the plunger is formed to include a receptacle for receiving articles therein. The aperture formed in the front panel of the housing is spaced apart from the top end of the housing by a predetermined distance, and the plunger has a predetermined length from a top surface to a bottom surface of the plunger which is substantially equal to said predetermined distance. The spring loaded platform biases the stack of diapers upwardly against the bottom surface of the plunger to position the top diaper in alignment with the aperture in the front panel of the housing. The spring loaded platform includes at least two springs which have a first end coupled to the platform and a second end coupled to the housing adjacent the top end of the housing.

The illustrated apparatus further includes a removable container located in the interior region of the housing in communication with the second portion of the interior region. The container is configured to receive the waste material deposited into the second region. A door is formed in a lower portion of the housing to provide access to the container for removal of the waste material from the container. The closure device is preferably spring biased to a normally closed position.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
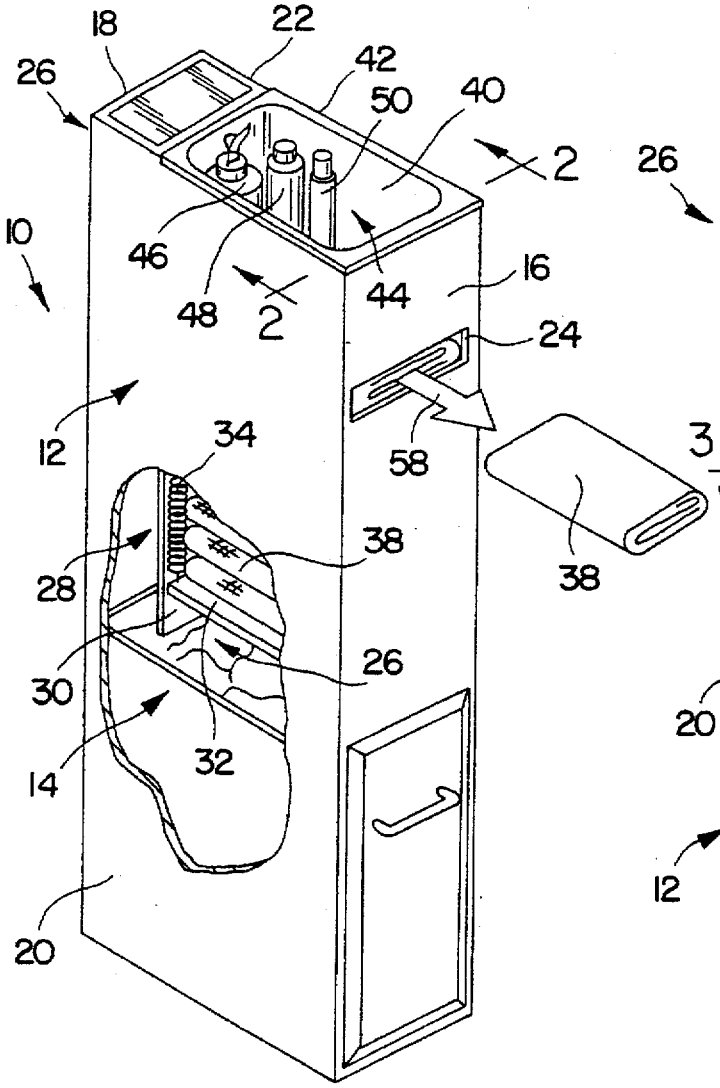
FIG. 1 is a perspective view, with portions broken away illustrating the diaper dispenser apparatus and waste receptacle of the present invention.

Referring now to the drawings, FIG. 1 illustrates a diaper dispenser apparatus 10 of the present invention. The dispenser apparatus 10 includes a housing 12 having an interior region 14. The housing includes a front panel 16, a rear panel 18, and first and second side panels 20 and 22 which define the interior region 14. Front panel 16 is formed to include an aperture 24 located near a top end 26 of housing 12. The interior region 14 of housing 12 is divided into a first portion 26 and a second portion 28 by a partition 30. The housing 12 may be made from either plastic or wood.

A spring loaded platform 32 is located in the first portion 26 of interior region 14. One end of a spring 34 is coupled to each corner of platform 32. Opposite ends of the springs 34 are coupled to fasteners 36 located near top end 26 of housing 12. In an alternate embodiment, a spring may be located below the platform. A plurality of diapers 38 are stacked onto platform 32. Diapers 38 are installed are platform 32 by removing a plunger 40 from a top opening 43 of housing 12. The plunger 40 includes an outer flange 42 for engaging top end 26 of housing 12. Plunger 40 includes an open interior region defining a receptacle 44 for holding articles such as baby wipes 46, powder 48, lotion 50, etc. This top receptacle 44 permits easy access to these articles while handling a baby. Plunger 40 is preferably secured to the housing 12 with a suitable fastener.

Figure 2:
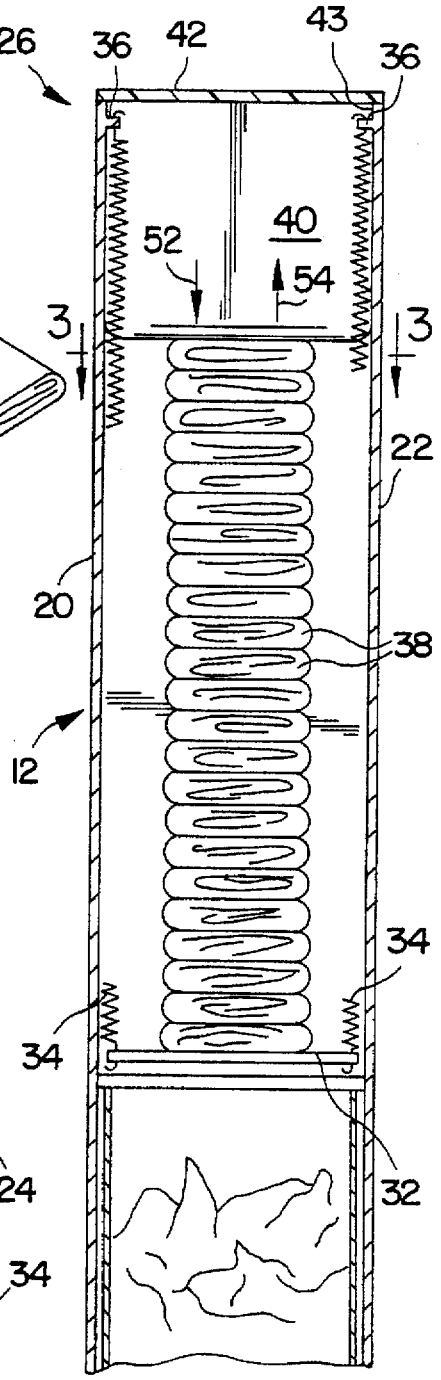
FIG. 2 is a sectional view taken along lines 2—2 of FIG. 1 further illustrating structural details of the dispenser apparatus.
Figure 3:
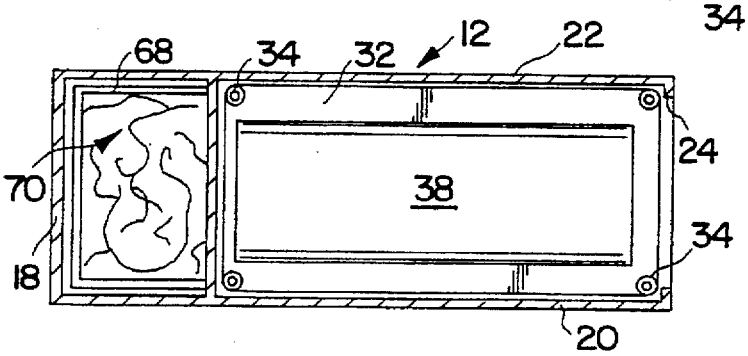
FIG. 3—3 is a sectional view taken along lines 3—3 of FIG. 2.
Figure 4:
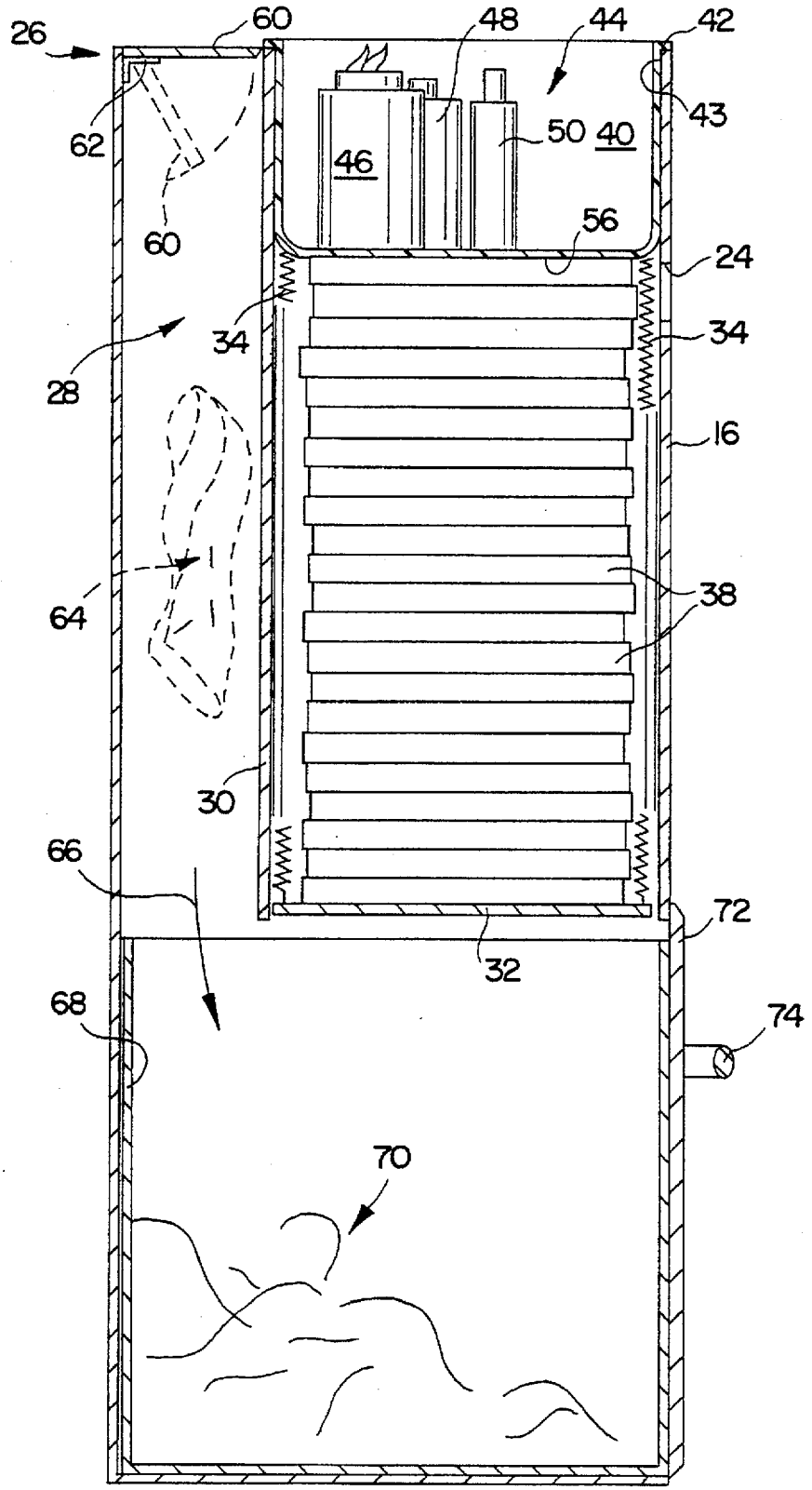
FIG. 4 is a sectional view taken through the dispenser apparatus of FIG. 1 illustrating further details of the dispenser apparatus.

When it is desired to load diapers 38 into the dispenser apparatus 10, plunger 40 is removed from opening 43. Diapers 38 can then be installed onto the platform. Plunger 40 is then inserted back into opening 42 to push the diapers 38 and platform 32 downwardly in the direction of arrow 52 of FIG. 2. Plunger 40 is then secured to housing 12 by the suitable fastener. Springs 34 bias the platform 32 upwardly in the direction of arrow 54. As best illustrated in FIG. 4, the receptacle 40 includes a bottom surface 56 which is aligned with the aperture 24 formed in front panel 16 of housing 12. Therefore, a top diaper 38 can be accessed and removed through aperture 24 as illustrated by arrow 58 of FIG. 1. By locating the aperture 24 near a top end 26 of housing 12, the caregiver has easy access to the diapers 38. Therefore, the parent or caregiver does not have to bend over while holding a child to access the diapers 38. The distance between flange 42 and bottom surface 56 of plunger 40 is substantially equal to the distance between the top end 26 of housing 12 and aperture 24.

As illustrated in FIGS. 1 and 4, the second portion 28 of the interior region 14 of housing 12 includes a door or closure device 60 located near top end 26. Closure device 60 is biased to a normally closed position by a spring hinge 62. Second portion 28 of interior region 14 therefore provides a waste receptacle for receiving soiled diapers or other waste material. When closure device 60 is moved downwardly to the open dotted position of FIG. 4, waste material or soiled diapers 64 may be inserted into the second portion 28 of interior region 14. The soiled diapers 64 fall downwardly due to gravity in the direction of arrow 66 into a container 68 for receiving the waste material 70. Access to container 68 is provided by door 72. An operator can grip handle 74 to open the access door 72. The access door 72 may be separate from or coupled to the container 68. Container 68 is removable from housing 12 for removing waste material 70 and for cleaning the container 68.

Although the invention has been described in detail with reference to a certain preferred embodiment, variations and modifications exist within the scope and spirit of the present invention as described and defined in the following claims.

What is claimed is:

1. An apparatus for dispensing diapers comprising:

a housing having an interior region and a top end formed to include a top opening, the housing including a front panel formed to include an aperture therein spaced apart from the top end;

a spring loaded platform located in an interior region of the housing, the platform being configured to support a stack of diapers and to locate a top diaper on the stack in alignment with the aperture in the front panel of the housing to permit removal of the top diaper through the aperture; and a plunger coupled to the top opening formed in the housing for applying a downwardly directed biasing force to the stack of diapers and the platform, the plunger being removable to permit loading of diapers onto the platform through the top opening in the housing.

2. The apparatus of claim 1, wherein the plunger is formed to include a receptacle for receiving articles therein.

3. The apparatus of claim 2, wherein the plunger receptacle is uncovered to permit easy access to the articles in the receptacle while handling the diapers and a baby.

4. The apparatus of claim 1, wherein the aperture formed in the front panel of the housing is spaced apart from the top end of the housing by a predetermined distance, and wherein the plunger has a predetermined length from a top surface to a bottom surface of the plunger which is substantially equal to said predetermined distance, the spring loaded platform biasing the stack of diapers coupled upwardly against the bottom surface of the plunger to position the top diaper in alignment with the aperture in the front panel of the housing.

5. The apparatus of claim 1, wherein the spring loaded platform includes at least two springs which have a first end coupled to the platform and a second end coupled to the housing adjacent a top end of the housing.

6. The apparatus of claim 1, wherein the platform has a rectangular shape including four corners, the spring loaded platform including a spring located at each corner, each spring having a first end coupled to the platform and a second end coupled to the housing adjacent a top end of the housing.

7. The apparatus of claim 1, wherein the interior region of the housing is divided into a first portion and a second portion, the spring loaded platform being located in the first portion of the housing and the second portion of the housing providing an opening for receiving waste material.

8. The apparatus of claim 7, further comprising a removable container located in the interior region of the housing in communication with the second portion of the interior region, the container being configured to receive the waste material deposited into the second region.

9. The apparatus of claim 8, further comprising a door formed in a lower portion of the housing to provide access to the container for removal of the waste material from the container.

10. The apparatus of claim 1, wherein the plunger is movable in a direction parallel to a longitudinal axis of the housing to move the diapers and the spring loaded platform downwardly during loading of the diapers into the housing.

11. An apparatus for dispensing diapers comprising:

a housing having an interior region divided into a first portion and a second portion, the second portion of the housing providing including a top opening for receiving waste material, the housing including a front panel formed to include an aperture therein;

a spring loaded platform located in the first portion of the interior region of the housing, the platform being configured to support a stack of diapers and to locate a top diaper on the stack in alignment with the aperture in the front panel of the housing to permit removal of the top diaper through the aperture; and a closure device positioned adjacent the top opening of the second portion, the closure device being movable from a closed position to an open position to permit waste material to be inserted past the closure device and into the second region of the housing.

12. The apparatus of claim 11, wherein the closure device is spring biased to a normally closed position.

13. An apparatus for dispensing diapers comprising:

a housing having an interior region which is divided into a first portion and a second portion, the housing including a front panel formed to include an aperture therein;

a spring loaded platform located in the first portion of the interior region of the housing, the platform being configured to support a stack of diapers;

a plunger coupled to a top opening formed in a top end of the housing for applying a downwardly directed biasing force to the stack of diapers and the platform to locate a top diaper on the stack in alignment with the aperture in the front panel of the housing to permit removal of the top diaper through the aperture, the plunger being removable to permit loading of diapers onto the platform through the top opening in the housing; and a closure device positioned adjacent a top opening of the second portion of the interior region of the housing, the closure device being movable from a closed position to an open position to permit waste material to be inserted past the closure device and into the second region of the housing.

14. The apparatus of claim 13, wherein the plunger is formed to include a receptacle for receiving articles therein.

15. The apparatus of claim 13, wherein the aperture formed in the front panel of the housing is spaced apart from the top end of the housing by a predetermined distance, and wherein the plunger has a predetermined length from a top surface to a bottom surface of the plunger which is substantially equal to said predetermined distance, the spring loaded platform biasing the stack of diapers upwardly against the bottom surface of the plunger to position the top diaper in alignment with the aperture in the front panel of the housing.

16. The apparatus of claim 13, wherein the spring loaded platform includes at least two springs which have a first end coupled to the platform and a second end coupled to the housing adjacent the top end of the housing.

17. The apparatus of claim 13, further comprising a removable container located in the interior region of the housing in communication with the second portion of the interior region, the container being configured to receive the waste material deposited into the second region.

18. The apparatus of claim 17, further comprising a door formed in a lower portion of the housing to provide access to the container for removal of the waste material from the container.

19. The apparatus of claim 13, wherein the closure device is spring biased to a normally closed position.

* * * * *